US008117966B1

(12) United States Patent
Graber

(10) Patent No.: US 8,117,966 B1
(45) Date of Patent: Feb. 21, 2012

(54) STUN GRENADE

(76) Inventor: Curtis E. Graber, Woodburn, IN (US)

( * ) Notice: Subject to any disclaimer, the term of this patent is extended or adjusted under 35 U.S.C. 154(b) by 149 days.

(21) Appl. No.: 12/313,426

(22) Filed: Nov. 20, 2008

Related U.S. Application Data

(60) Provisional application No. 61/005,600, filed on Dec. 6, 2007.

(51) Int. Cl.
*F42B 8/00* (2006.01)

(52) U.S. Cl. ..... 102/498; 102/367; 102/368

(58) Field of Classification Search ..... 102/498, 102/367–370, 530, 512–513, 502, 529; 116/210; 446/220–226; 181/116, 117, 118
See application file for complete search history.

(56) References Cited

U.S. PATENT DOCUMENTS

| | | | | |
|---|---|---|---|---|
| 3,039,559 | A * | 6/1962 | Ellsworth | 181/142 |
| 4,461,117 | A | 7/1984 | Gott | |
| 4,634,395 | A * | 1/1987 | Burchett | 446/222 |
| 5,083,771 | A * | 1/1992 | Tyner | 472/54 |
| 5,133,260 | A * | 7/1992 | Grosch | 102/401 |
| 5,222,798 | A | 6/1993 | Adams | |
| 5,246,372 | A | 9/1993 | Campagnuolo et al. | |
| 5,370,161 | A * | 12/1994 | Shafer | 141/114 |
| 5,654,523 | A | 8/1997 | Brunn | |
| 6,142,894 | A | 11/2000 | Lee | |
| 6,324,955 | B1 * | 12/2001 | Andersson et al. | 89/1.11 |
| 6,373,384 | B1 * | 4/2002 | Ferguson et al. | 340/540 |
| 6,477,979 | B1 * | 11/2002 | Sanchez | 116/210 |
| 6,488,557 | B1 * | 12/2002 | Elliott et al. | 446/220 |
| 6,545,092 | B2 | 4/2003 | Parker | |
| 6,688,555 | B1 * | 2/2004 | Kneisl | 244/118.5 |
| 6,767,108 | B1 | 7/2004 | Blachowski et al. | |
| 7,191,708 | B2 | 3/2007 | Ouliarin | |
| 7,412,929 | B2 | 8/2008 | Walsh | |
| 2006/0043712 | A1 * | 3/2006 | Hakki et al. | 280/735 |
| 2006/0081147 | A1 * | 4/2006 | Walsh | 102/368 |
| 2006/0166171 | A1 * | 7/2006 | Preston et al. | 434/16 |
| 2007/0169658 | A1 * | 7/2007 | Brock | 102/367 |
| 2008/0216699 | A1 * | 9/2008 | McAleer et al. | 102/367 |
| 2009/0038497 | A1 * | 2/2009 | Van Der Plaats et al. | 102/498 |
| 2010/0058947 | A1 | 3/2010 | Davis et al. | |
| 2010/0072895 | A1 | 3/2010 | Glynn et al. | |

OTHER PUBLICATIONS

Definition of "Predetermine". The American Heritage® Dictionary of the English Language, Fourth Edition copyright © 2000 by Houghton Mifflin Company. Updated in 2009. Published by Houghton Mifflin Company. All rights reserved.*

* cited by examiner

*Primary Examiner* — Gabriel Klein
(74) *Attorney, Agent, or Firm* — Paul W. O'Malley; Susan L. Firestone

(57) ABSTRACT

A stun grenade that provides a flash and an associated loud report without use of pyro-ignition sources. The flash is generated by discharge of a conventional flash bulb. The loud, explosive noise comes from rupturing of an inflatable bag at a predetermined rupture pressure and inflation volume.

10 Claims, 5 Drawing Sheets

STUN GRENADE

PRIORITY CLAIM

This application claims the benefit of U.S. Provisional Patent Application No. 61/005,600 filed 6 Dec. 2007.

BACKGROUND

1. Technical Field

The field relates to non-lethal missiles for practice, controlling crowds and subduing individuals, and more particularly to non-pyrotechnic grenade simulators and stun grenades.

2. Description of the Art

Stun grenades are typically hand thrown missiles which include a small pyrotechnic charge to create a flash of light and noise. A common factor in injuries caused by stun, diversionary and practice grenades used by the military for training and police for subduing suspects and controlling crowds has been the pyro-technic charge. With any pyro-technic device there is always a potential for fire resulting from their use.

Non-pyrotechnic grenade type devices are known, including the "Thumper TG6" training grenade sold by Airsoft World Ltd. of the United Kingdom. This device utilizes compressed carbon dioxide to rupture a burst diaphragm to produce a load noise.

U.S. Pat. No. 6,767,108 for a Non-Lethal Flash Grenade provides a transparent housing enclosing an array of flash lamps and an ignition circuit for activating a first, centrally located lamp in the array with the remaining array lamps being sympathetically activated in response to flash of the centrally located lamp.

SUMMARY

Provided is a grenade like device, missile, or stun grenade, for generating a flash followed by a loud, explosive sounding noise. The missile includes a canister housing a compressed gas source. The compressed air source is connected by a conduit to an inflatable bag. A valve in the conduit controls the discharge of gas through the conduit from the compressed gas source to the inflatable bag to first inflate and then rupture the bag. A manually actuated external trigger is installed on the canister for use in activating the valve to discharge gas to the inflatable bag. A flash source is installed on the canister for generating external illumination. The canister has an open end. A cap fitted over the open end houses the inflatable bag situated at the lower end prior to inflation. A control circuit is installed within the canister for illuminating the flash source and for actuating a solenoid controlling the valve. The external handle mounted on the canister triggers operation of the printed circuit board upon release. A safety pin prevents unintended operation of the external handle until removed.

BRIEF DESCRIPTION OF THE DRAWINGS

Understanding of the following description may be enhanced by reference to the accompanying drawings, wherein.

DETAILED DESCRIPTION

Figure 1:
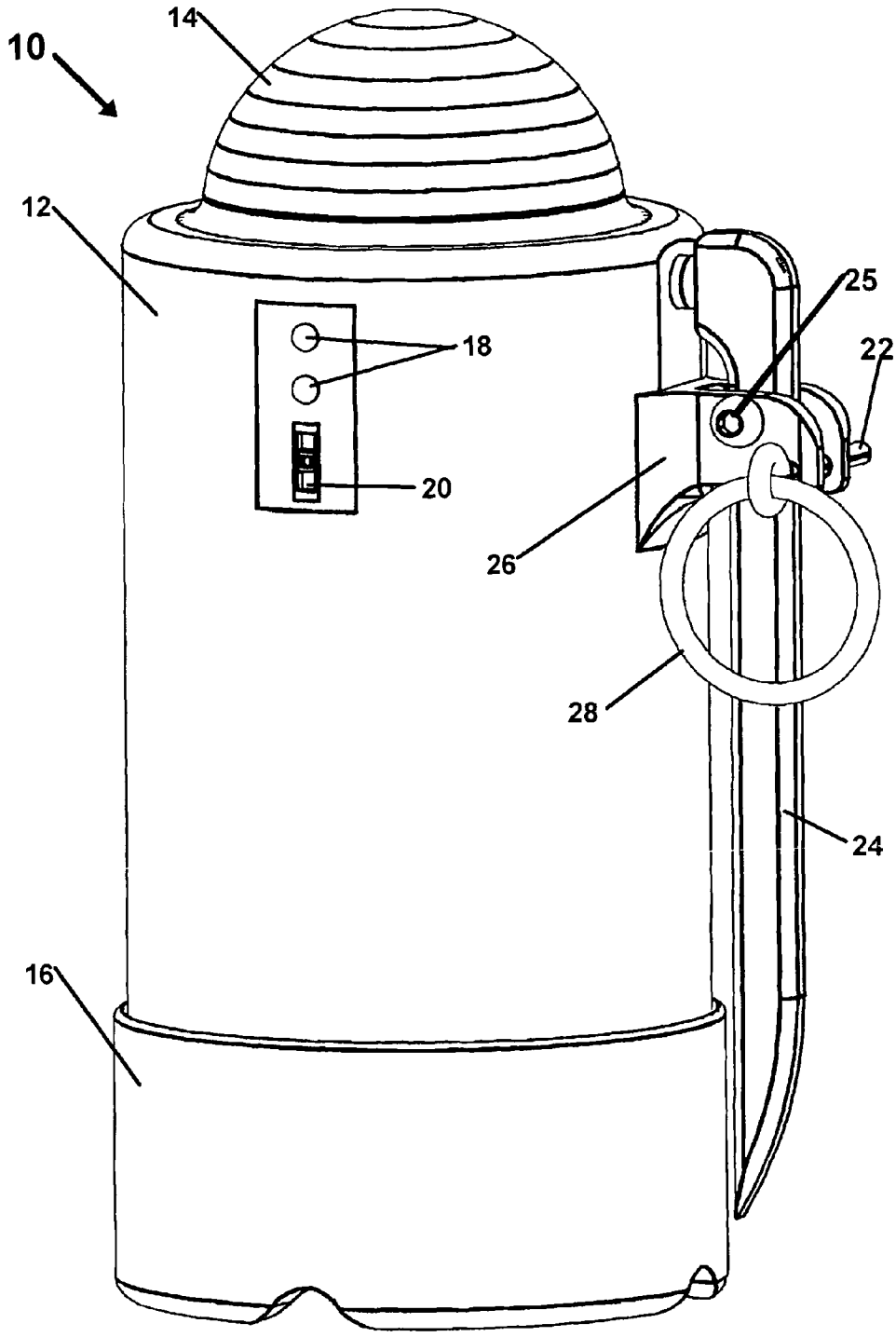
FIG. 1 is perspective view of a stun grenade.
Figure 2:
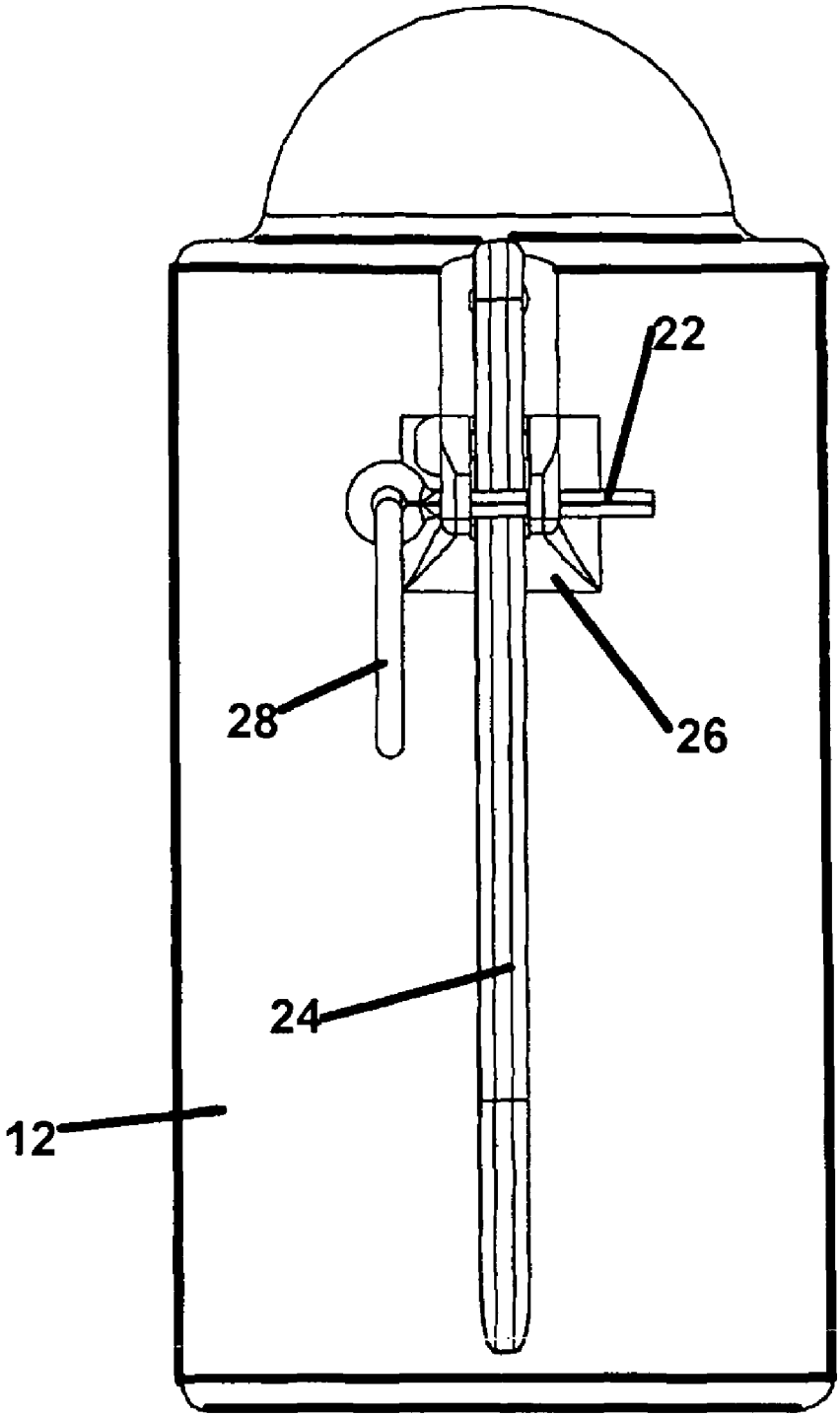
FIG. 2 is a side elevation illustrating the safety pin and trigger handle of the stun grenade.

Referring now to the drawings and in particular to FIGS. 1 and 2, a stun grenade 10 is illustrated. Stun grenade 10 includes a housing in the form of a hard shell plastic, cylindrical canister 12, which is sized to be easily grasped in an adult's hand. Canister 12 is topped by a faceted cap 14, which protects a flash bulb and which is made of a transparent or translucent material to transmit light. The facets of cap 14 may be sections of a Fresnel lens, which is useful in focusing emitted light into zones of high intensity light. Cap 14 transmits a light burst associated with use of the device. The bottom of the canister is closed by a readily removable soft plastic cap 16. Cap 16 is blown free of the canister 12 during use of the stun grenade 10 and accordingly is made of soft plastic to minimize the chance of injury to people nearby should the cap strike them.

On the exterior surface of the canister 12 are light emitting diode (LED) indicator lights 18 and a timing select switch 20. Stun grenade 10 operates on compressed gas, and indicator lights 18 may be used to indicate presence of a charged gas cylinder in the canister 12 and whether a pressurization line leading from the gas cylinder to an inflatable bag is charged. Alternatively the status lights 18 may simply indicate that the stun grenade 10 has power and is armed. The use of status lights 18 is optional. The LED indicator lights 18, if present, operate only when stun grenade 10 is active to save power and may emit red and green light, respectively, to indicate ready to use status and gas cylinder availability.

The illustrated stun grenade 10 is intended to emulate a conventional U.S. Military issue hand grenade in handling. Accordingly, a safety pin 28 and a triggering handle 24 are provided installed on the exterior of canister 12. Handle 24 is pivotally mounted on a fulcrum 26 extending outwardly from the canister 12. Handle 24 is spring loaded to open outwardly below fulcrum 26 on release of the handle resulting in the internal gas cylinder being pierced to release compressed gas. During storage and prior to use the handle 24 is restrained from opening by a pin 22 fitted through the fulcrum at a point downwardly displaced from the pivot 25 of the fulcrum 26. Pin 22 is removed from the fulcrum on turning and pulling safety ring 28. Other configurations of size, shape and triggering sequence for a stun grenade are of course possible.

Figure 3:
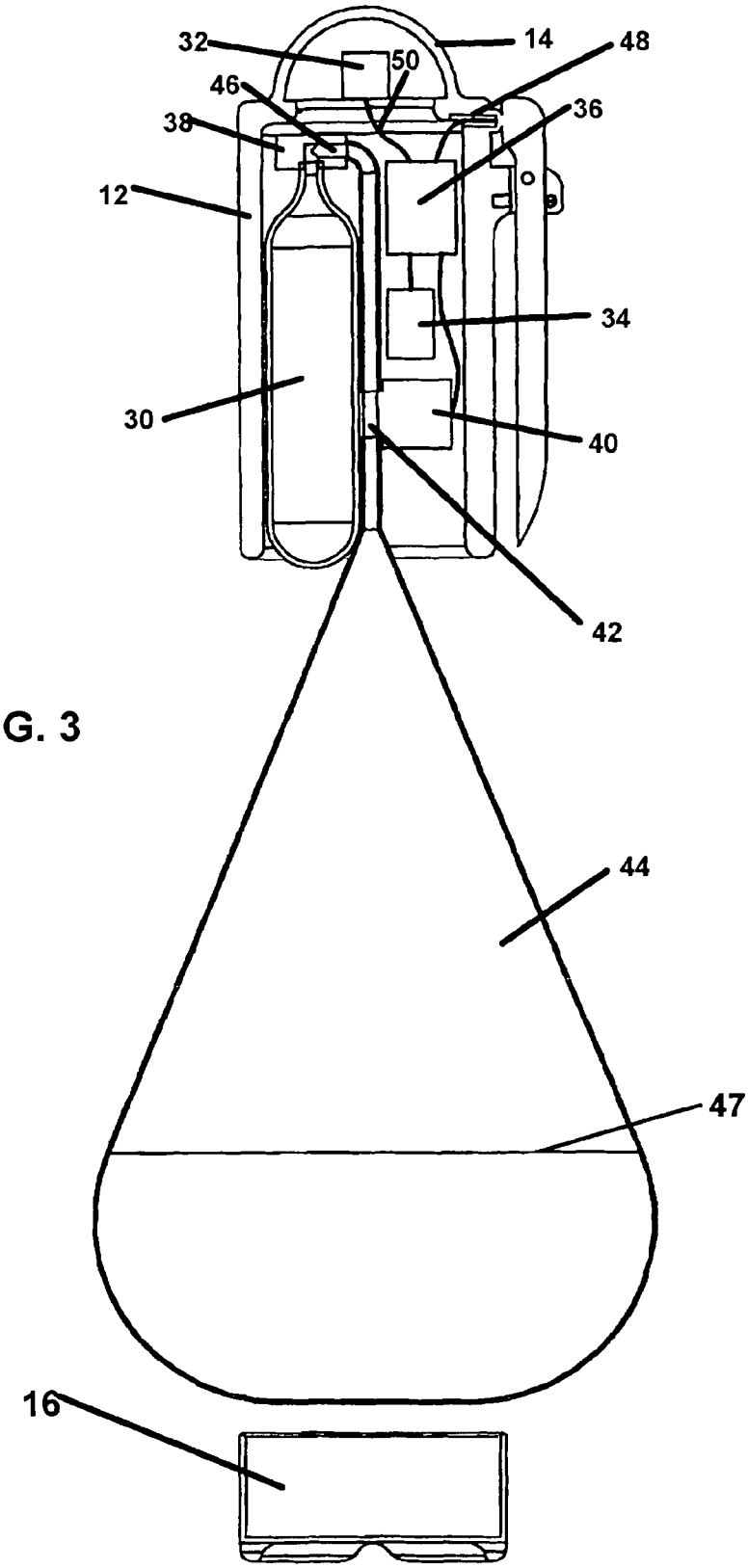
FIG. 3 is a cross-sectional view of the stun grenade with the inflatable bag deployed.

Referring now to FIG. 3, the internal components of the stun grenade 10 and its operation are described. Stun grenade 10 works on the principal that a loud, explosive like noise is generated upon an inflated inflatable bag 44 bursting. Inflatable bag 44 is fabricated from like or similar material as used in an automotive inflatable bag, and includes a rupture seam 47 which is designed to part abruptly at a predetermined extension. The sudden opening the inflatable bag 44 at a predetermined degree of stretching of the inflatable bag, or more precisely, tension on the rupture seam, produces an explosive sound. However, unlike automotive applications where a pyrotechnic gas generator is used to achieve rapid deployment, the present invention uses compressed gas to inflate the bag. While inflation rates matching those obtained using pyrotechnic devices are not needed, inflation should be rapid enough to prevent an unprepared witness from deducing the true character of the device. Compressed gas is supplied from a compressed gas cylinder 30 installed within canister 12. Compressed nitrogen is used due to avoid major changes in available pressure which would result from using common compressed carbon dioxide cylinders when ambient temperature changes can subject the contents of the cylinder to wide pressure variation. It may be possible to use compressed air in many situations, or even carbon dioxide, if ambient conditions are not expected to affect the device. Gas is discharged from cylinder 30 to inflatable bag 44 in two stages along a conduit 46 which connects the cylinder to the inflatable bag. First, a piercing mechanism actuated by opening of handle 24 discharged gas from the cylinder into the conduit. Gas is released from the conduit 46 into the bag upon opening of a valve 42 in the conduit by operation of a solenoid 40.

Upon opening of valve 42 gas is released into inflatable bag 44 which rapidly expands, displacing cap 16 from the bottom of canister 12. In order to achieve sufficiently rapid deployment of the inflatable bag 44 it is desirable that gas be pressurized in cylinder 30 to the range of 800 to 1000 psi. The flow volume of conduit 46 should be at least 60 cubic feet per minute at the working pressure of the cylinder 30. The high rate of inflation is desirable in order to give the target individual or crowd little or no time to appreciate the situation upon use of the grenade 10.

The noise is generated not from inflation of the air bag 44, but upon rupture of the inflatable bag 44 along seam 47 and the consequent explosive release of gas from the inflatable bag. In order to achieve the greatest possible noise an N-wave shockwave of high intensity should be developed. The volume and pressure of inflatable bag 44 at the moment of rupturing determine the peak pressure of the resulting shock wave. The target intensity is 170-175 db at one meter distance from the inflatable bag 44. In order to achieve this level of sound intensity the inflatable bag 44 is preferably inflated to a volume in the range of 800 to 900 cubic inches at the moment of rupture. Rupture should occur at an internal pressure in inflatable bag 44 at a minimum pressure of about 150 psi, but in any event in a narrow range around the selected target pressure. Fabrication of rupture seam 47 using a thread of known diameter and known tensile strength allows rupture calibration to be made relatively exact. Other pressure targets and volumes may be selected for applications other than for use of the missile as a stun grenade 10. For example, a missile set up for use as a practice grenade may rupture at a smaller volume and lower pressure.

The psychological effect of the stun grenade 10 may be enhanced by providing a flash before the report from the expanding inflatable bag 44 is heard. Accordingly a magnesium based flash bulb 32 is located at the top of cylinder 12, under the transparent cap 14. Flash bulb 32 is illuminated just before rupturing of the inflatable bag 44 as described below.

Operation of the flash bulb and the solenoid 40 are electronically controlled. A printed circuit board 36 is located within canister 12 to support the circuitry necessary to implement operation of the flash bulb 32, deployment of the inflatable bag 44 and operation of the LED status lights 18. Printed circuit board 36 is supplied with power from a button cell 34. When stun grenade 10 is armed by removal of safety pin 22, the printed circuit board 36 may report an active status by illuminating an LED status light 18. Opening of handle 24 provides a signal to the printed circuit board to illuminate flash bulb 32 and to actuate solenoid 40. These actions occur upon programmed delays of a few seconds, with the illumination of the flash bulb 32 occurring 10-12 milliseconds before rupturing of the inflatable bag 44. Power to illuminate flash bulb 32 is provided by a wire 50. The delay between release of the handle 24 and occurrence of the flash and report of the rupturing inflatable bag 44 may be selected using the slide switch 20 which may be connected to a potentiometer to provide a variable strength signal to the printed circuit board 36.

Figure 4:
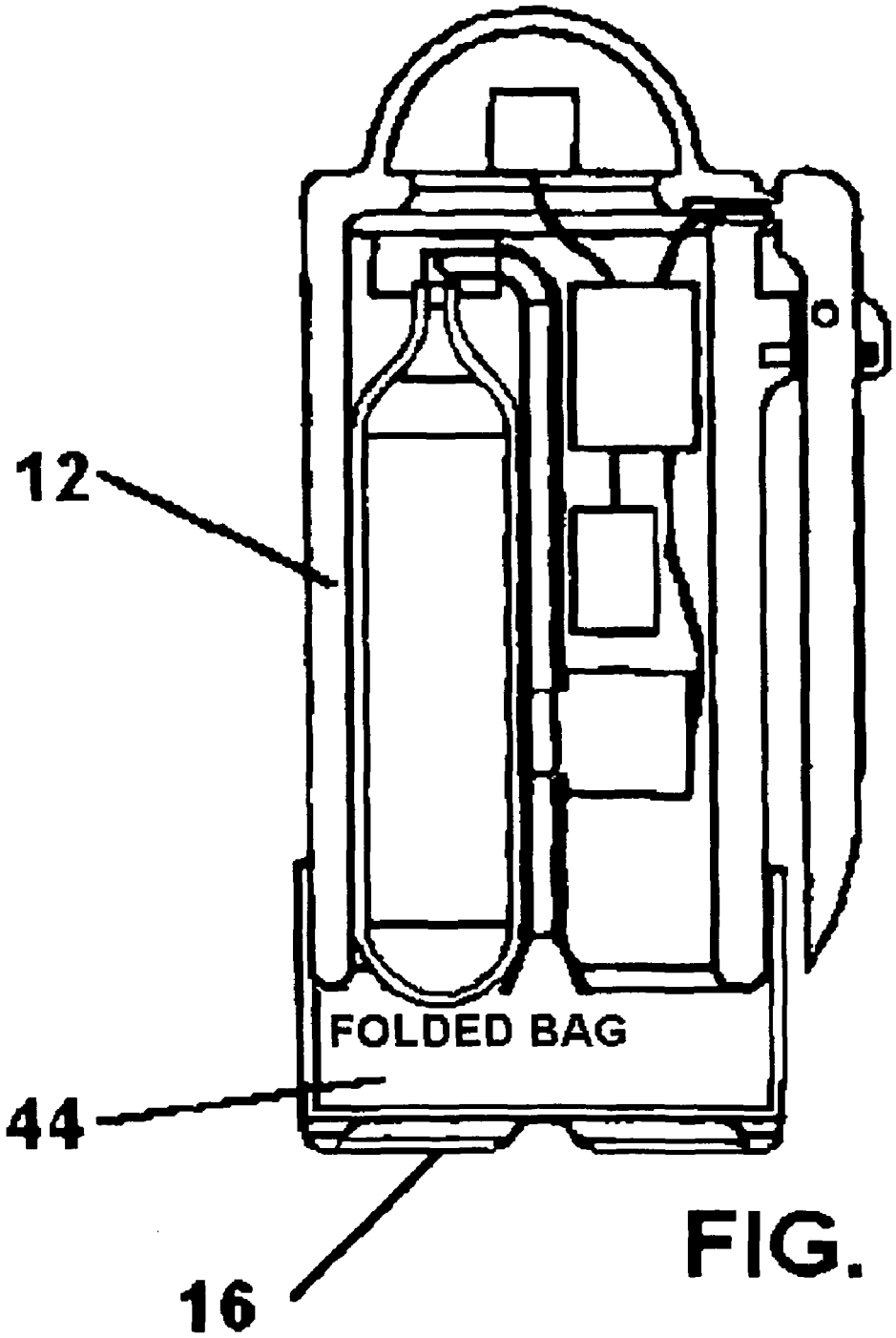
FIG. 4 is a cross-sectional view of the stun grenade prior to deployment of the inflatable bag.

Referring to FIG. 4, inflatable bag 44 is illustrated as folded within cap 16 of the stun grenade 10. Cap 16 fits around the exterior of canister 12, and is retained in place by friction between the interior of the cap and the exterior of the canister. Inflation of the inflatable bag 44 will push the cap 16 from the end of the canister 12.

Figure 5:
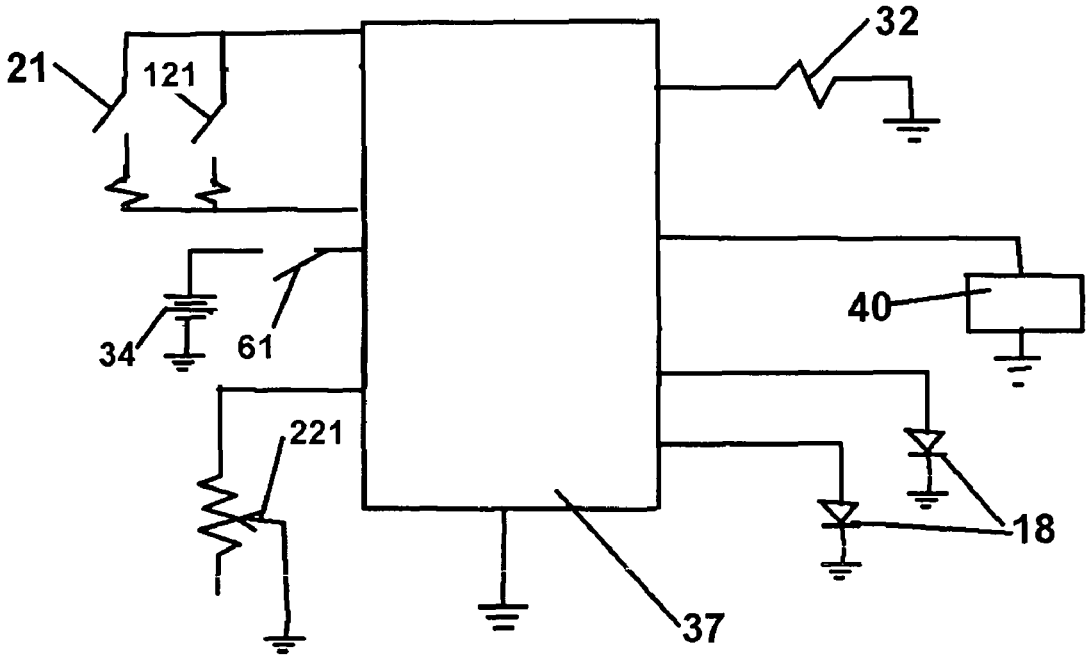
FIG. 5 is a control schematic of the firing circuit for the stun grenade.

FIG. 5 illustrates control arrangements for the device in a schematic fashion. The controls provide for arming, setting timing and triggering the device. In addition, operational readiness can be signaled. Electrical power is supplied to a controller 37 from a battery/coin cell 34 via an on/off switch 61 operation of which arms the device. On/off switch 61 may be operated by removal of pin 22, or by another, dedicated pole mounted on an outside surface of the canister 12. Switches 21 and 121, which are series connected with differentiated resistors, are scanned by controller 37 to determine if the device has been trigger handle 24 and if an intact compressed air cylinder is in place. Switch 21 is closed by operation of the trigger A rheostat 221 is provided which can be adjusted to vary the time delay between activation of the flash bulb 32 and operation of the solenoid 40, which is used to open a valve to discharge air from a storage cylinder. LED status lights 18 are used to indicate that the device is usable or not. Aural signals may be substituted for LEDs. A charging capacitor (not shown) may be used to operate the flash bulb 32.

The stun grenade has been shown in only a few of its possible configurations. It is not thus limited but is susceptible to various changes and modifications.

What is claimed is:

1. A stun grenade comprising:

a canister;

a compressed gas source installed within the canister supporting gas flow at a predetermined minimum rate;

an inflatable bag having a target pressure and a target volume to initiate a shock wave of an intensity selected to achieve a minimum noise intensity at a prescribed distance upon rupture;

the inflatable bag incorporating a seam which parts at a tension and extension occurring at the target pressure and target volume to produce the rupture;

a conduit connecting the compressed gas source to the inflatable bag;

the compressed gas source supporting gas flow to the inflatable bag through the conduit at a predetermined minimum rate to achieve the target pressure and volume for parting the seam within a fixed period;

a valve in the conduit for controlling discharge of gas through the conduit from the compressed gas source to the inflatable bag; and a manually actuated external trigger installed on the canister to activate the valve to discharge gas to the inflatable bag.

2. The stun grenade of claim 1, further comprising:

a flash source installed on the canister for generating external illumination.

3. The stun grenade of claim 2, further comprising:

the canister having an open end;

a cap fitted over the open end;

the inflatable bag being stored before deployment at least partly within the cap and providing for displacement of the cap from the canister upon inflation.

4. The stun grenade of claim 3, further comprising:

a control circuit installed within the canister for illuminating the flash source and for actuating a solenoid controlling the valve; and the control circuit being responsive to operation of the manually actuated trigger for operating to illuminate the flash source a programmed period before the inflatable bag reaches the target volume and pressure for rupturing.

5. The stun grenade of claim 4, further comprising:

the external trigger is electrically connected to the control circuit to initiate operation of the solenoid and flash source; and a safety pin for preventing unintended operation of the external trigger until removed.

6. A grenade simulator comprising:

a housing;

a compressed gas source installed in the housing;

an inflatable bag incorporating a seam which parts abruptly along its length upon inflation of the inflatable bag past a predetermined minimum size and internal pressure selected to generate a shock wave producing a minimum noise level at a prescribed distance;

a delivery control conduit for discharging of gas from the compressed gas source to the inflatable bag;

the compressed gas source supporting gas flow to the inflatable bag through the delivery control conduit at a predetermined minimum rate to achieve the predetermined minimum size and internal pressure for rupturing within a period; and a manual trigger installed on the housing, actuation of which causes the discharge of gas by the delivery control conduit to the inflatable bag.

7. The grenade simulator of claim 6, further comprising:

a flash source installed on the housing for generating a light flash;

a flash activation circuit responsive to operation of the manual trigger and connected to the flash source for activating the flash source; and the flash activation circuit timing activation of the flash source to be closely correlated in time with rupturing of the inflatable bag.

8. The grenade simulator of claim 7, further comprising:

the housing including a canister having an open end;

a cap for fitting over the open end; and the inflatable bag being stored before deployment at least partly within the canister and positioned to displace the cap from the open end of the canister upon inflation.

9. The grenade simulator of claim 8, further comprising:

a control circuit installed within the canister for illuminating the flash source and for actuating a solenoid controlling the delivery control conduit; and the control circuit operating to activate the flash source a programmed period before the predetermined minimum size and internal pressure for rupturing for the inflatable bag is reached upon inflation.

10. The grenade simulator of claim 9, further comprising:

a status indicator.

* * * * *